US005638990A

United States Patent [19]

Kastberg

[11] Patent Number: 5,638,990

[45] Date of Patent: Jun. 17, 1997

[54] SQUEEZABLE CONTAINER WITH SPREADING KNIFE

[76] Inventor: David J. Kastberg, P.O. Box 224, Dillon, Colo. 80435

[21] Appl. No.: 431,730

[22] Filed: May 1, 1995

[51] Int. Cl.[6] ..... B65D 35/36

[52] U.S. Cl. ..... 222/106; 222/191; 222/192

[58] Field of Search ..... 222/92, 106, 191, 222/192, 556

[56] References Cited

U.S. PATENT DOCUMENTS

| | | | |
|---|---|---|---|
| 708,709 | 9/1902 | Henneberry et al. . | |
| 1,673,590 | 6/1928 | Redheffer | 222/106 X |
| 1,878,475 | 9/1932 | Driest | 222/106 X |
| 2,560,381 | 7/1951 | Babington | 224/5 |
| 2,770,826 | 11/1956 | Curfman | 222/192 X |
| 2,804,767 | 9/1957 | Schoen | 72/138 |
| 2,921,716 | 1/1960 | Schiller | 222/92 |
| 2,943,338 | 7/1960 | Lowen | 15/105 |
| 3,070,823 | 1/1963 | Heinig | 15/507 |
| 3,088,470 | 5/1963 | Hall | 132/79 |
| 3,133,300 | 5/1964 | Freeman | 15/236 |
| 3,221,940 | 12/1965 | Watson, Jr. | 222/96 |
| 3,257,039 | 6/1966 | Trutza et al. | 222/102 |
| 3,302,235 | 2/1967 | Gerber | 15/552 |
| 3,450,313 | 6/1969 | Jonas | 222/402.13 |
| 4,244,525 | 1/1981 | Manna | 222/192 X |
| 4,817,229 | 4/1989 | Sedillo | 15/104 S |
| 4,949,883 | 8/1990 | Dubach | 222/556 |

FOREIGN PATENT DOCUMENTS

| | | | |
|---|---|---|---|
| 981394 | 1/1951 | France . | |
| 1120327 | 4/1956 | France . | |
| 0650508 | 12/1962 | Italy | 222/92 |
| 642256 | 8/1950 | United Kingdom . | |
| 2076378 | 12/1981 | United Kingdom | 222/556 |
| 8904796 | 6/1989 | WIPO | 222/192 |

*Primary Examiner*—Joseph Kaufman
*Attorney, Agent, or Firm*—Welsh & Katz, Ltd.

[57] ABSTRACT

A container for viscous fluids or materials, such as wall patching compound includes a hollow, flexible, tubular body having a spreading knife mounted to an end thereof. The container includes a nozzle on an opposite end of the tubular body through which the contents of the container are expelled. The container may include a cap on the end of the body at the nozzle for covering the nozzle. The cap may be hinged to the container to permit "one-handed" use of the container to, for example, open the container, expel or squeeze out the material in the container, close the container, and spread the material over an associated surface, such as a wall.

9 Claims, 1 Drawing Sheet

SQUEEZABLE CONTAINER WITH SPREADING KNIFE

FIELD OF THE INVENTION

This invention pertains to containers for storing viscous materials; more particularly, the invention pertains to containers for storing materials such as wall patching or wall board joint compound, which containers provide an air-tight seal and include a spreading knife integral therewith.

BACKGROUND OF THE INVENTION

Materials, such as wall patching compound or wall board joint compound are available, generally, in large containers such as tubs or drums, and smaller containers, such as tubes. Particularly, wall patching compounds are available in the smaller, tube-type containers.

In use, these materials are squeezed or expelled from the tube in an appropriate amount for the required task. The material is then spread over the area to be covered using a separate trowel or spreading knife.

Typically, this operation requires the use of both hands to open the container, dispense or expel the material from the container, close the container, and spread the material on the surface which needs to be repaired. This operation can be particularly cumbersome when the user is standing, for example, on a ladder or an elevated surface.

Another drawback to known containers is that many such containers do not provide an air-tight seal to keep the material fresh and usable. The material which is exposed to air tends to harden and become unusable. This is particularly troublesome with tube-type containers which have small nozzle openings to discharge the material. If the material hardens in the nozzle, the tube is generally unusable, and the entire tube must be discarded.

Thus, there continues to be a need for a container for materials such as wall patching compound, which permits "one-handed" operation, and which container provides an air-tight seal to maintain the compound in a fresh, usable condition.

SUMMARY OF THE INVENTION

A container for viscous fluids or materials, such as wall patching compound is disclosed which includes a flexible tubular body having a spreading knife mounted to an end thereof. The container includes a nozzle on an opposite end of the tubular body through which the contents of the container are expelled.

The container may include a cap on the end of the body for covering the nozzle. In one embodiment, the cap is hinged to the container.

In a preferred embodiment, the nozzle is formed at angle in the range of about 30° to about 60° relative to a centerline of the container.

The container permits "one-handed" operation and use, to, for example, open the container, expel or squeeze out the material in the container, close the container, and spread the material on an associated surface, such as a wall.

Other features and advantages of the present invention will be apparent from the following detailed description, the accompanying drawings, and the appended claims.

DETAILED DESCRIPTION OF THE PREFERRED EMBODIMENTS

Figure 1:
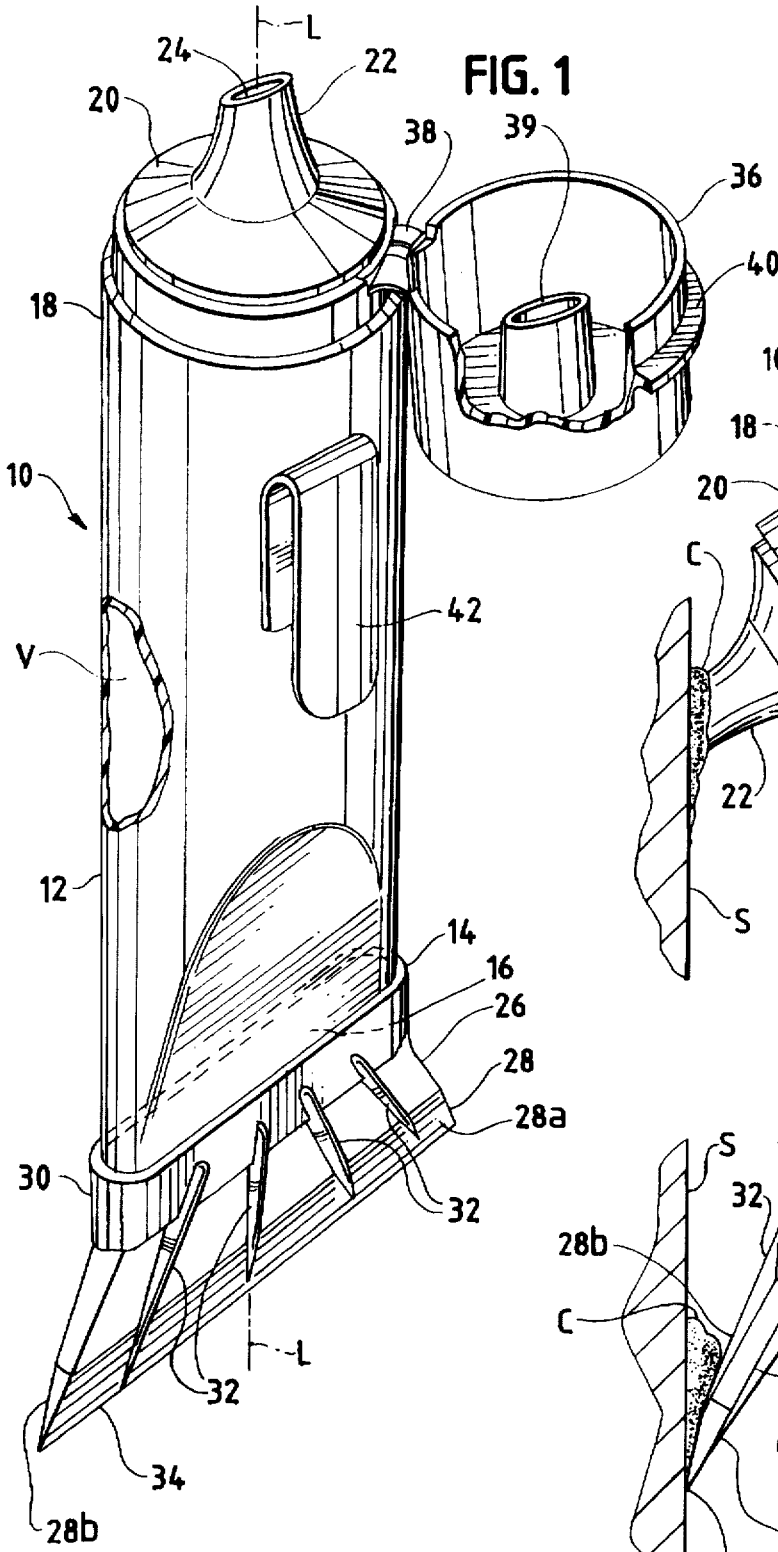
FIG. 1 is a perspective view of a squeezable container having a spreading knife and a hinged cap, and showing the container body partially broken away, in accordance with the principles of the present invention.
Figure 2:
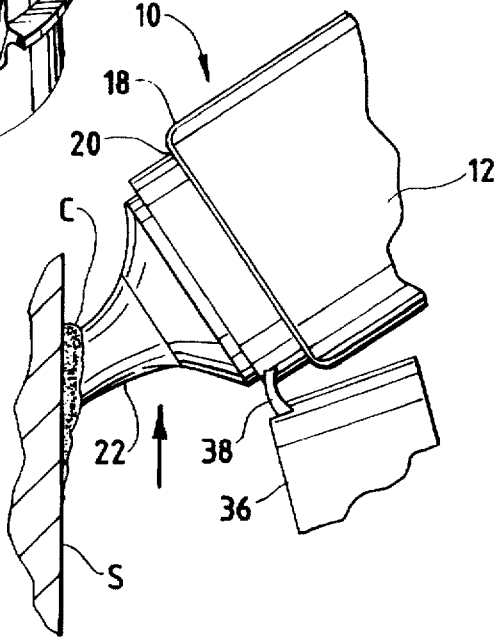
FIG. 2 is a partial elevational view of the container of FIG. 1, showing the cap in the open position, and showing the contents of the tube being expelled on an associated surface.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to FIG. 1, there is shown a squeezable container 10 of the present invention. The container may be used to store viscous fluids, such as wall patching compound, or wall joint compound or the like. Other types of fluids or materials may, of course be stored in such a container 10, and such use is intended to be within the scope of the present invention.

The container 10 has a flexible tubular body 12 having a sealed, first end portion 14, having a seal 16 therealong. The container body 12 is deformable and defines a deformable internal volume V.

The seal 16 is generally transverse to the body 12. The container 10 has a second end portion 18 from which the contents C of the container 10 are expelled, and which terminates in a wall 20.

A nozzle 22 extends from the wall 20, and has an opening 24 which is adapted to accommodate passage of the contents C from the container 10.

A spreading knife 26 is mounted to the container 10 at about the first, sealed end 14. The spreading knife includes a rigid blade portion 28 and a mounting portion 30 which is adapted to receive the sealed end 14 and the seal 16 of the container 10.

In a preferred embodiment, the blade 28 is wider than the body 12 of the container. This provides a larger spreading surface for spreading the contents C from the container 10. The spreading knife 26 may also include ribs 32 extending therealong to provide additional rigidity and strength to the knife 26.

Figure 3:
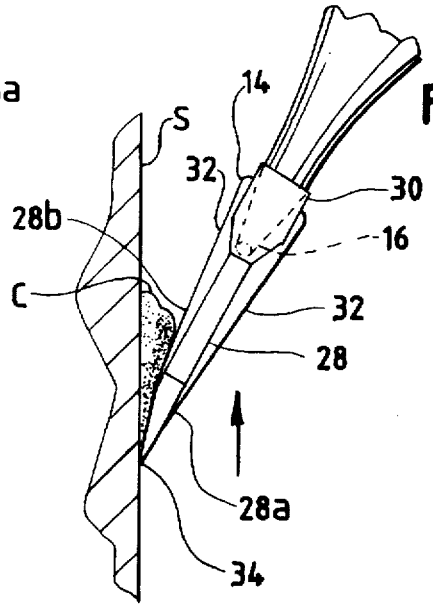
FIG. 3 is a partial elevational view of the container of FIG. 1, showing the spreading knife being used to spread the dispensed contents of the container on the associated surface.

As is best seen in FIG. 3, the blade 28 forms an edge 34 at the end thereof. This facilitates spreading of the contents C of the container on an associated surface S, such as a wall. The edge 34 also permits working the material into any cracks or joints, and smoothing the material along the surface S.

As best seen in FIG. 3, the blade 28 is symmetrical relative to the blade sides **28*a* and 28*b*. The reinforcing ribs 32 extend from about the mounting portion 30, along the blade 28, to about the edge 34. The ribs 32 are formed generally transverse to the edge 34, and may be symmetrically formed on the blade sides 28*a*,*b***.

The container 10 may also include a cap, such as the exemplary hinged cap 36, shown in FIG. 1. The exemplary cap 36 includes a hinged portion 38 which mounts the cap 36 to the container 10. Other types of caps, such as threaded caps, may be used for the present invention as will be recognized by one skilled in the art. Such other caps are within the scope of the present invention.

The cap 36 may include a sealing portion 39, to provide a relatively air-tight seal or boundary between the contents C and the environs, at the nozzle 22. The seal prevents exposure of the contents C to air, and helps to retain the contents C in the container 10 in a usable, fresh state.

The cap 36 may include a portion, such as the exemplary thumb ridge 40, to permit easy opening, i.e., one-handed operation, of the container 10.

Typically, as compounds such a patching compound, are exposed to air, they harden and become unusable. The seal arrangement of the present invention prevents the hardening of such compounds by providing a relatively air-tight seal, and maintains the compound in a usable condition.

In one embodiment of the container 10, the nozzle 22 may be angled to permit a more easily controlled application of the contents C onto the surface S. Preferably, the nozzle angle is in a range of about 30° to about 60° relative to a centerline L of the container. In this embodiment, the container 10 is symmetrical about the centerline L.

The container 10 may also include a hook portion or member 42, such as the exemplary belt hook illustrated in FIG. 1. In one embodiment, the hook 42 is located on the tubular body portion 12. The hook 42 permits a user to position the container 10 on the user's garments, such as on a belt. This allows the user easy access to the container 10 when in use and facilitates storage when not in use. The hook 42 may also be mounted to the cap 36 or the spreading knife 26.

The container 10 of the present invention permits "one-handed" use. This is particularly advantageous when the user is on a ladder or an elevated which requires the user to maintain a hand-hold to remain in place.

The container 10 can be removed from the user's belt or other garment, and held in one hand. With that same hand, the user can open the container 10 by applying pressure on the cap 36 at for example, the ridge 40. The container 10 can then be squeezed to dispense the appropriate amount of material in place. The cap 36 can be replaced, and the container 10 can be inverted to use the spreading knife 36 to smooth the material in place over the surface S.

Thus, with one-handed operation, a user can open the container 10, expel material, close the container 10 and smooth he material in place. All of this can be performed while maintaining a hand-hold as necessary to steady the user, as for example, if the user is on a ladder.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A flexible container for storing and dispensing a viscous fluid comprising:

a flexible tubular body having a sealed, first end portion and a second end portion terminating in a wall;

a nozzle extending from said wall, said nozzle adapted to accommodate passage of the viscous fluid; and a rigid blade portion adapted to be mounted to said sealed, first end portion, and being adapted to spread the fluid dispensed from said container, on an associated surface, said blade portion being symmetrical and having a mounting portion and an edge, said blade portion being tapered from said mounting portion toward said edge and including a plurality of spaced apart, symmetrical reinforcing ribs extending from said mounting portion to about said edge, generally transverse thereto, wherein said container is substantially symmetrical about a centerline extending therethrough, and wherein said nozzle extends from said wall, said nozzle terminating in a discharge portion defining a passageway therethrough for said viscous fluid, said discharge portion being formed at an angle across said nozzle in a range of about 30° to about 60° relative to said centerline and relative to a centerline of said nozzle.

2. The flexible container of claim 1 further including a cap mounted thereto at about the wall.

3. The flexible container of claim 2 wherein said cap includes a sealing portion for providing a seal for said nozzle.

4. The flexible container of claim 2 wherein said cap is hinged.

5. The flexible container of claim 1 further including a hook member adapted to be mounted to said container for mounting said container to a user's garment.

6. The flexible container of claim 5 wherein said hook member is mounted to said tubular body portion.

7. A flexible container for storing and dispensing a viscous fluid, the container being substantially symmetrical about a centerline extending therethrough, the container comprising:

a flexible body defining a deformable internal volume and having a sealed, first end portion and a second end portion terminating in a wall;

a nozzle extending from said wall, said nozzle having a discharge portion defining a passageway therethrough, said discharge portion being formed at an angle in a range of about 30° to about 60° relative to said centerline and relative to a centerline of said nozzle, said nozzle being adapted to accommodate passage of the viscous fluid;

a cap mounted to said container by a hinge, said cap including a sealing portion for proving a relatively air-tight seal for said nozzle; and a rigid blade portion adapted to be mounted to said sealed, first end portion, and being adapted to spread the fluid dispensed from said container, on an associated surface, said blade portion being symmetrical and having a mounting portion and an edge, said blade portion being tapered from said mounting portion reward said edge and including a plurality of spaced apart, symmetrical reinforcing ribs extending from said mounting portion to about said edge, generally transverse thereto.

8. The flexible container of claim 7 further including a hook portion adapted to be mounted to said container for mounting said container to a user's garment.

9. The flexible container of claim 8 wherein said hook member is mounted to said tubular body portion.

* * * * *

UNITED STATES PATENT AND TRADEMARK OFFICE

CERTIFICATE OF CORRECTION

PATENT NO. : 5,638,990
DATED : June 17, 1997
INVENTOR(S) : David J. Kastberg

It is certified that error appears in the above-indentified patent and that said Letters Patent is hereby corrected as shown below:

Column 4, line 55, "reward" to --toward--.

Signed and Sealed this

Second Day of September, 1997

*Attest:*

Bruce Lehman

BRUCE LEHMAN

*Attesting Officer*

*Commissioner of Patents and Trademarks*